US007308792B2

(12) United States Patent
Alf et al.

(10) Patent No.: US 7,308,792 B2
(45) Date of Patent: Dec. 18, 2007

(54) STEAM POWER PLANT ARRANGEMENT

(75) Inventors: Martin Alf, Neunkirchen (DE); Reinhard Lötzsch, Forchheim (DE); Bernd Mikuteit, Duisburg (DE); Ernst-Wilhelm Pfitzinger, Mülheim an der Ruhr (DE); Jens Rosenkranz, Erlangen (DE); Günter Welser, Kleinsendelbach (DE); Thorsten Wolf, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/117,200

(22) Filed: Apr. 28, 2005

(65) Prior Publication Data

US 2005/0247060 A1 Nov. 10, 2005

(30) Foreign Application Priority Data

May 6, 2004 (EP) ..... 04010800
Nov. 15, 2004 (EP) ..... 04027097

(51) Int. Cl.
*F01K 7/34* (2006.01)

(52) U.S. Cl. ..... 60/653; 60/670

(58) Field of Classification Search ..... 60/643, 60/645, 653, 670
See application file for complete search history.

(56) References Cited

U.S. PATENT DOCUMENTS 3,061,533 A * 10/1962 Shannon ..... 376/219
3,915,124 A * 10/1975 Kuhn et al. ..... 122/115
4,049,971 A * 9/1977 le Febve de Vivy ..... 290/40 R
4,353,864 A * 10/1982 Morcov ..... 376/402
4,395,885 A * 8/1983 Cozby ..... 60/669
4,493,186 A * 1/1985 Emsperger et al. ..... 60/39.182
5,884,470 A * 3/1999 Frutschi ..... 60/783
6,029,454 A * 2/2000 Kefer et al. ..... 60/653
6,735,947 B1 * 5/2004 Dormeier et al. ..... 60/645
6,899,097 B1 * 5/2005 Mecham ..... 126/591

* cited by examiner

*Primary Examiner*—Hoang Nguyen

(57) ABSTRACT

A steam power plant arrangement with a steam turbine and a steam generator, a condenser and a preheating system is characterized according to the invention in that the steam generator, the condenser and the preheating system are configured as individual functionally and spatially defined function areas, which are arranged in a spatial installation concept in a distributed manner around the steam turbine.

5 Claims, 4 Drawing Sheets

STEAM POWER PLANT ARRANGEMENT

CROSS REFERENCE TO RELATED APPLICATION

This application claims priority of the European application No. 04010800.3 EP filed May 6, 2004, and European application No. 04027097.7 EP filed Nov. 15, 2004, both of which are incorporated by reference herein in their entirety.

FIELD OF THE INVENTION

The invention relates to a steam power plant arrangement with a steam turbine and a steam generator, condenser and a preheating system.

BACKGROUND OF THE INVENTION

Modern power plant arrangements or steam power plants comprise a number of units, linked to each other for functional purposes and constructed to nest within each other to achieve the best possible technical solution overall. Thus for example in the case of steam power plants, condensers are arranged below or to the side of a low pressure section of a low pressure section turbine, in order to achieve particularly short conduit lengths. In steam power plants however such a nested structure results in dependencies between the various units, which significantly complicates the planning of the plant as a whole, its production and in particular its assembly.

SUMMARY OF THE INVENTION

The object of the invention is to create a steam power plant arrangement with a steam turbine, which overcomes the above disadvantages and in particular allows cost savings to be made when planning and assembling the plant as a whole.

The object is achieved according to the invention with a steam power plant arrangement with a steam turbine and a steam generator, a condenser and a preheating system, in which the steam generator, the condenser and the preheating system are configured as individual functionally and spatially defined function areas, which are arranged in a distributed manner around the steam turbine in a spatial installation concept.

With the installation concept for a steam power plant arrangement according to the invention, self-contained units are created, which take on a specific technical function and are assigned specifically to an individual area within the installation concept. The concept according to the invention thus includes the permanent assignment of function areas and component installations, for example in a power house, which remains essentially unchanged, even if various site-specific influences change. Thus according to the invention a pre-planned solution can be implemented, the standardized modules of which can be planned, produced and even assembled alongside each other. This breaking down of planning, production and the assembly sequence is also beneficial in the event of subsequent revisions of the steam power plant arrangement according to the invention. Parallel assembly of such components as the condenser, turbine and generator is in particular possible according to the invention, which allows assembly times in particular to be significantly reduced. It is also possible in principle to assemble the function areas (e.g. the preheating system) in parallel with each other and also parallel to the assembly of the turbine system. The spatial installation concept according to the invention is in particular independent of the electric power to be generated, condenser pressures, the number of preheating stages and the steam discharge points and also essentially independent of electrotechnical considerations.

In one advantageous development of the steam power plant arrangement according to the invention, the steam turbine has a longitudinal axis and the condenser function area is arranged axially adjacent to the steam turbine. Such a steam turbine can be configured as a low installation, i.e. without a condenser arranged below it, which in particular simplifies the support structure for the steam turbine and can also reduce the overall height of the power house required. With such a steam power plant arrangement developed according to the invention, any impact from the cold end of the condenser function area on the installation of the turboset of the steam turbine are avoided, which result with known installation concepts due to the arrangement of the condenser there. So that the condenser function area can be arranged axially adjacent to the steam turbine, the steam turbine should in particular be configured with axial discharge at the turboset.

With the power plant arrangement according to the invention it is also advantageous, if the steam generator and/or the preheating system function areas is/are arranged adjacent to the elongated steam turbine, with the steam generator function area in particular being arranged on the side of the steam turbine opposite the preheating system function area. The steam generator and preheating system function areas thus arranged can be linked to the steam turbine according to the invention with particularly short conduit lengths and interactions between these function areas can essentially be avoided completely due to the spatial separation by the steam turbine arranged in between. There is also adequate space available for the large-volume steam generator function area with the boiler and steam conduits in such a spatial installation concept.

As well as the steam turbine integrated in a steam power plant arrangement according to the invention, it is also advantageous to have an electrical function area, which should be arranged in particular adjacent to a generator associated with the steam turbine and parallel to the above-mentioned preheating system function area. With an electrotechnical function area thus arranged, short conduit lengths can again be used, in this case for the electric cables.

Unlike known steam power plants, in which the condenser is often arranged below the turbine set, with the power plant arrangement according to the invention the steam turbine and said function areas are arranged largely on the same level. This is the case particularly for the function area of the steam turbine and the condenser. A condenser thus arranged, which is arranged along the same axis as the turbine, decouples the turbine installation from the cooling configuration. Thus as far as the cooling configuration is concerned, the cooling water temperature and/or the condenser pressure, a flow cooler or heat exchanger, a divided or undivided condenser and a single or dual path condenser can be chosen almost freely.

A series arrangement of the following function areas has proved to be a particularly advantageous assignment of the function areas within the power plant arrangement according to the invention: the steam turbine is longitudinally oriented and adjacent to a steam generator function area, a parallel arrangement of the preheating system function area and electrotechnical function area being provided on the opposite longitudinal side. The preheating function area is thereby adjacent, in particular in the area of a turbine set, to the steam turbine, while the electrotechnical function area is arranged next to a generator of the steam turbine. Such an arrangement can even be maintained in the event of a site-specific change in the number of preheating stages and steam discharge points and any adjustment to electrotechnical considerations that may be required.

Parallel to this said series arrangement, the condenser function area is particularly advantageously configured as an elongated field, which extends parallel to the series arrangement. In such a condenser function area there is a high level of variability, without any resulting impact on the other function areas.

Between the said function areas according to the invention connecting elements, e.g. pipes, should advantageously be provided, which serve as steam conduits and water conduits and/or electric cables to connect the function areas for functional purposes. These connecting elements can be largely standardized, creating defined interfaces for the planning, production and assembly of the steam power plant arrangement according to the invention.

BRIEF DESCRIPTION OF THE DRAWINGS

An exemplary embodiment of a steam power plant arrangement according to the invention is described in more detail below with reference to the accompanying schematic drawings, in which.

DETAILED DESCRIPTION OF THE INVENTION

Figure 1:
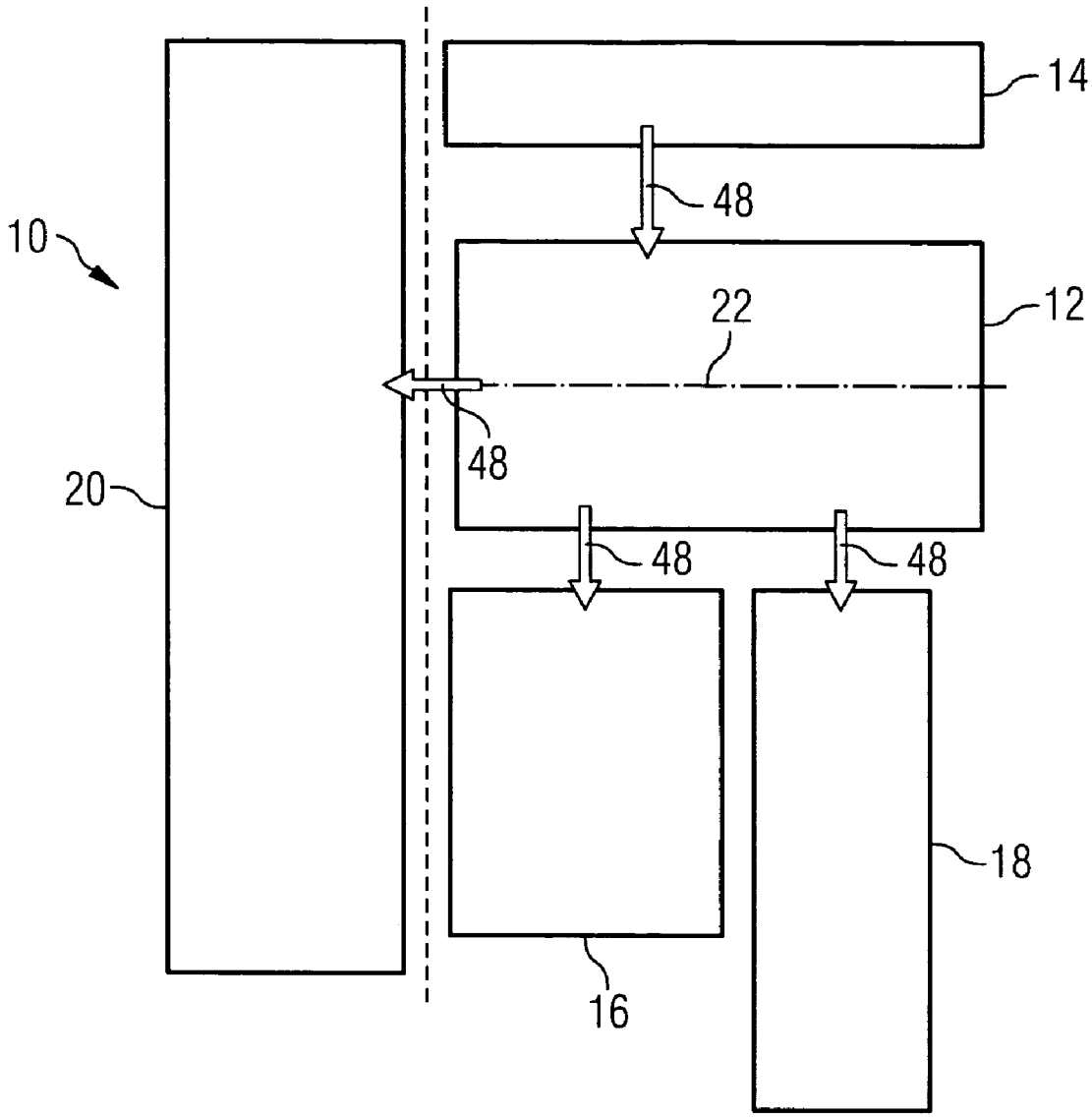
FIG. 1 shows a highly schematic top view of an exemplary embodiment of a steam power plant arrangement according to the invention.

The Figures show a steam power plant arrangement 10, the structural elements of which are combined and grouped in function areas. The function areas are assigned to each other functionally and spatially in a planned manner in the nature of an installation concept. In particular a steam turbine function area 12, a steam generator function area 14, a preheating system function area 16, an electrotechnical function area 18 and a condenser function area 20 are provided as function areas. The field 14 of the steam generator function area shown in FIG. 1 only represents the steam conduits between the steam generator and the steam turbine. The steam generator itself is adjacent to this field.

Figure 2:
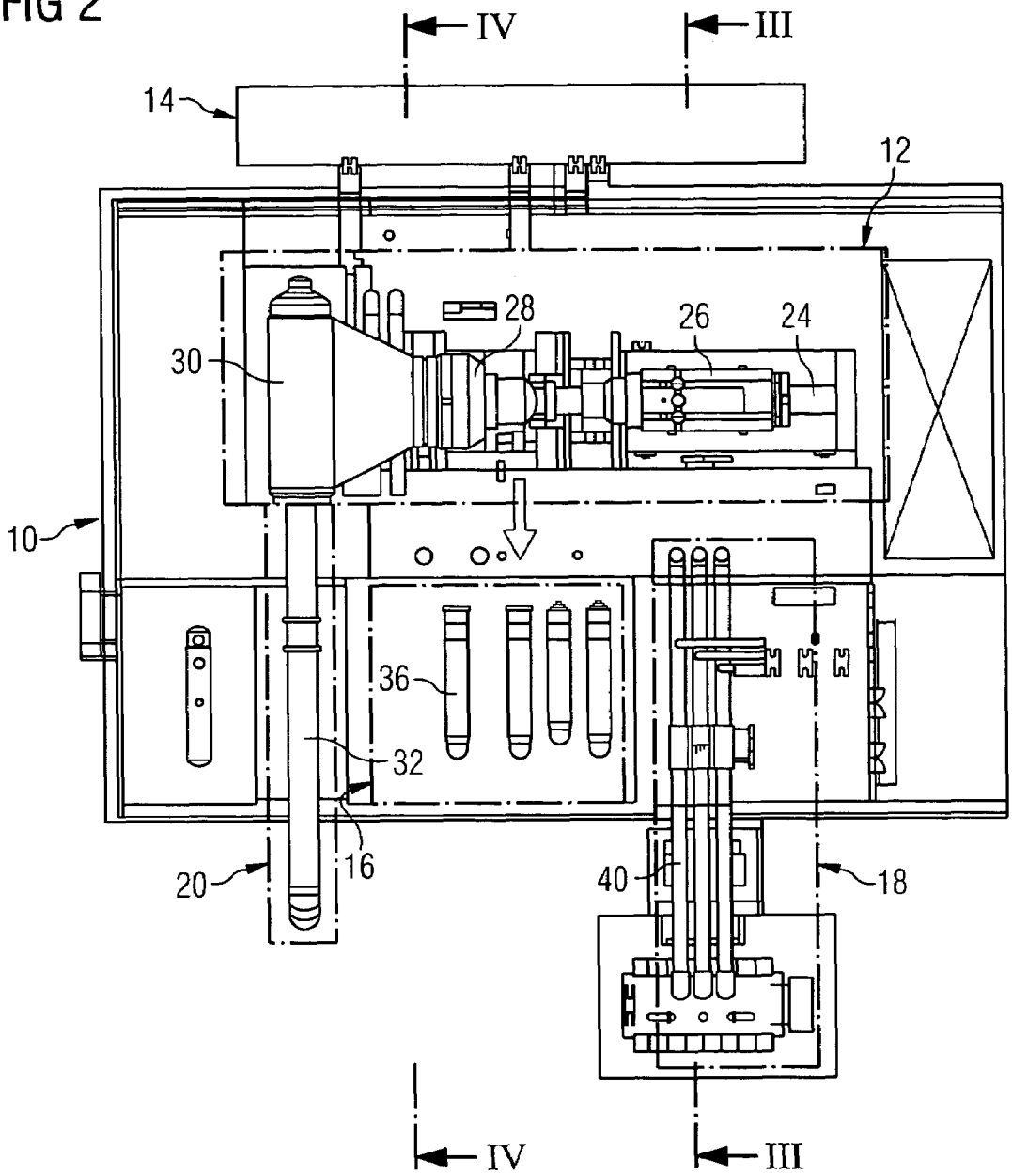
FIG. 2 shows a detailed top view of the steam power plant arrangement according to FIG. 1.

The core of the steam power plant arrangement 10 is formed by the steam turbine function area 12, which extends along a longitudinal axis 22 and has as its structural elements an energization system 24, a generator 26 arranged next to this and a turbine set 28 also adjacent in a longitudinal direction. Adjacent to this on the left front face of the steam turbine function area 12 according to FIGS. 1 and 2 is the condenser function area 20. In this condenser function area 20 a condenser 30 receives a stream of steam from the axial discharge from the turbine set 28. Conduits 32 supplying cooling water are also provided perpendicular to the longitudinal axis 22 at the condenser 30, so that the condenser function area 20 overall covers an essentially rectangular area, which is oriented perpendicular to the longitudinal axis 22 of the steam turbine function area 12.

Parallel to this condenser function area 20 a series or sequential arrangement of the remaining function areas is configured across the steam turbine function area 12. This series arrangement contains in particular the steam generator-function area 14 provided at the upper edge of the arrangement in relation to FIGS. 1 and 2. This steam generator-function area 14 in particular contains a large-volume boiler (not shown). The steam generator function area 14 extends with a longitudinal side along the steam turbine function area 12.

Figure 3:
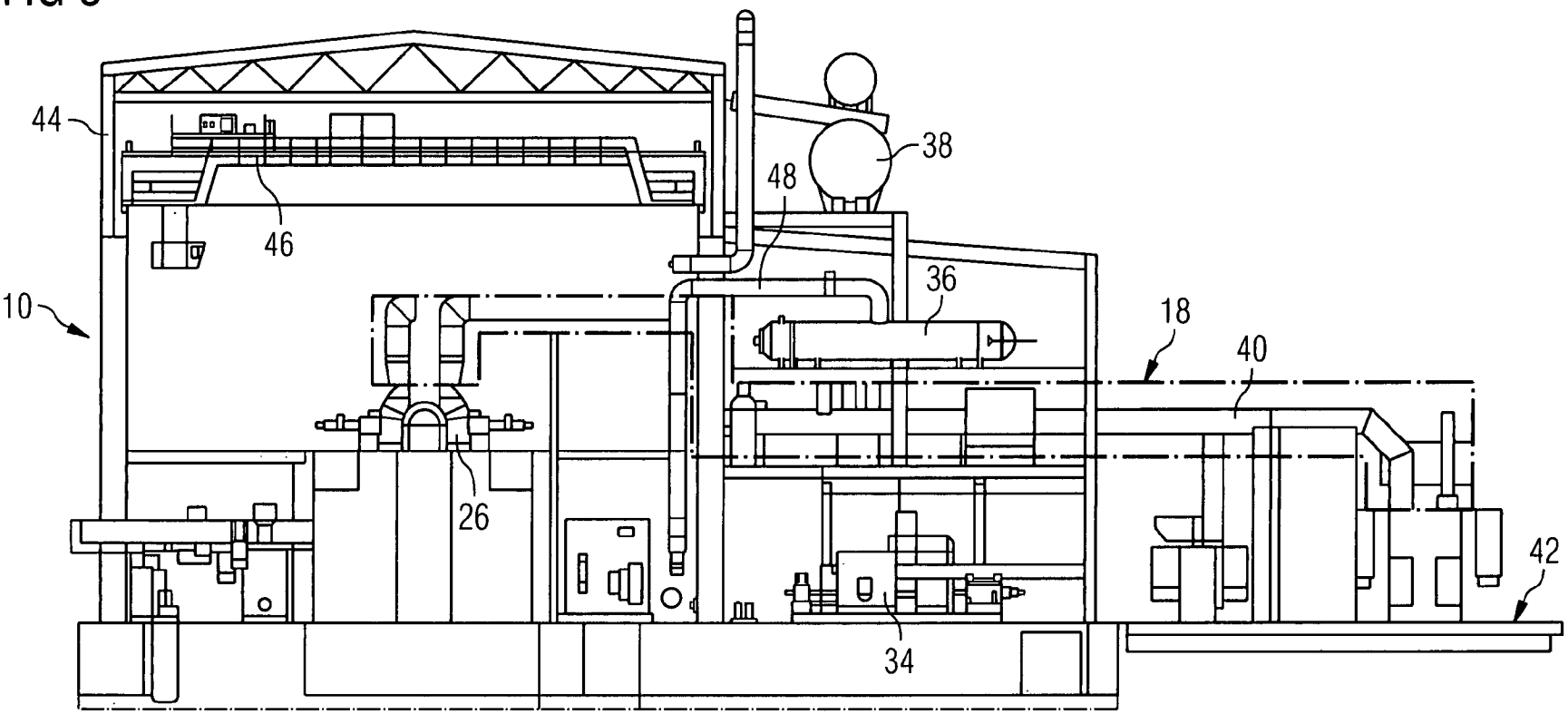
FIG. 3 shows the section III-III according to FIG. 2
Figure 4:
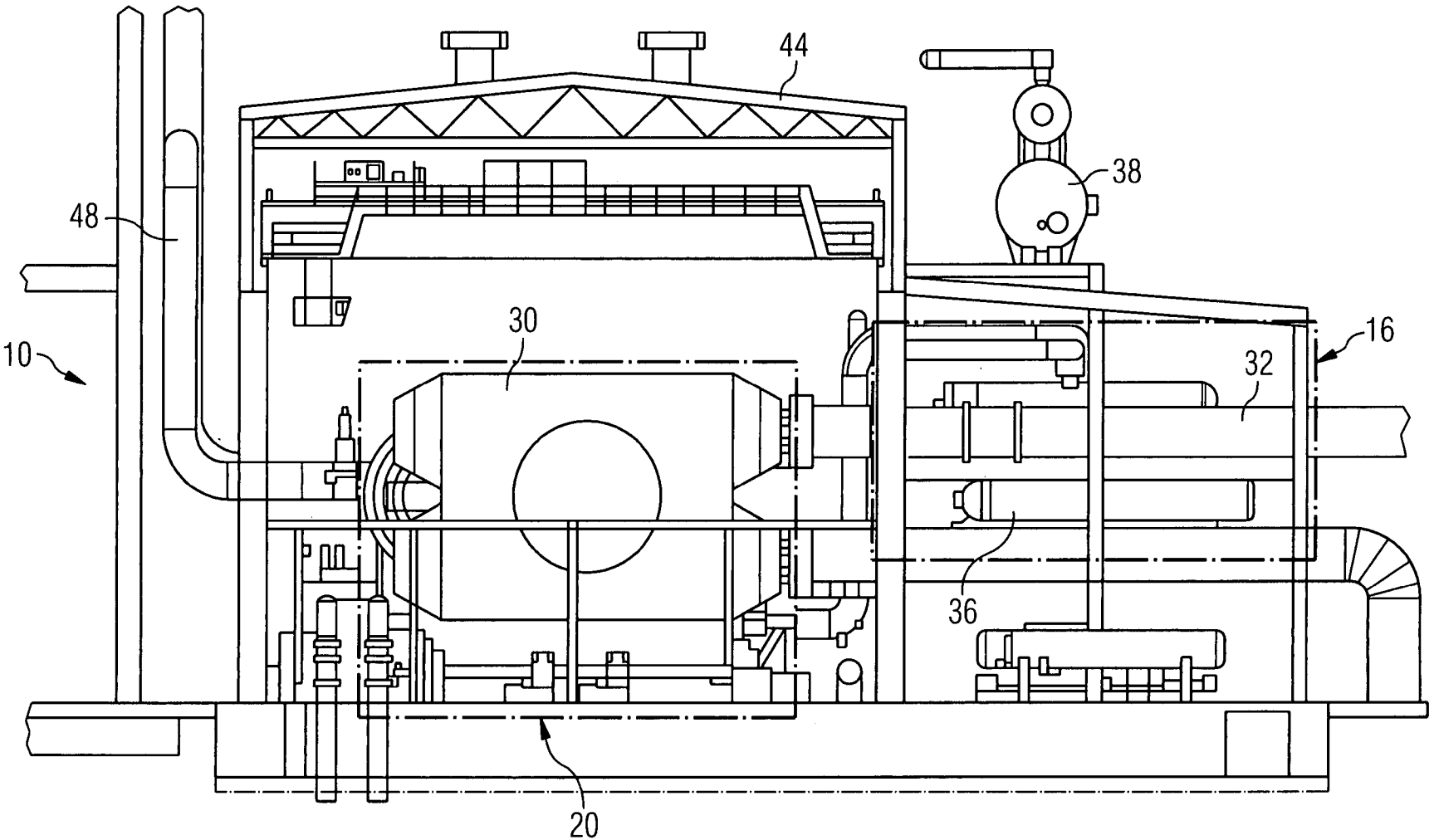
FIG. 4 shows the section IV-IV according to FIG. 2.

On the longitudinal side of the steam turbine function area 12 opposite the steam generator function area 14 are the two function areas preheating system 16 and electrotechnical 18. The preheating system function area 16 is thereby arranged next to the turbine set 28 of the steam turbine function area 12, while the electrotechnical function area 18 is configured next to the generator 26 and the energization system 24. The preheating system function area 16 comprises in particular a vertical arrangement of supply pumps 34, a preheating system 36 arranged above these and oriented perpendicular to the longitudinal axis 22 and a water supply tank 38 extending parallel to the longitudinal axis 22 (see FIG. 3).

The electrotechnical function area 18 contains in particular a generator connection 40, which extends to some extent across the generator 26 and is directed outwards from there in stages.

The steam power plant arrangement 10 with its function areas is as a whole arranged essentially on a single level, base level 42. The longitudinal axis 22 of the steam turbine function area 12 is thereby at around a height of between approximately six and eight meters, in particular around seven meters, above this base level 42. The turbine set 28 in particular is thereby enclosed by a power house 44, in which there is also a power house crane 46.

The individual function areas 12 to 20 referred to above are, as shown in FIG. 1, linked together by connecting elements 48, which are for example configured as steam conduits or electric cables.

In other words the steam power plant arrangement 10 is thus characterized by a number of function areas, which are assigned functionally and spatially to each other in a planned manner in the nature of an installation concept and by a steam turbine installed at a low level with axial discharge.

The function areas contain a condenser and a preheating section and/or electrotechnical components, for example a switching unit and/or an energy take-off and/or a steam generator and/or connecting elements, e.g. pipes, in particular steam conduits, and/or electric cables, to connect at least two function areas for functional purposes.

The condenser is essentially arranged at the same level as the steam turbine. A sequential arrangement of the function areas steam generator, steam turbine and a parallel arrangement of the preheating section and electrotechnical components is also present. Parallel to this sequential arrangement is a function area for cooling, which primarily contains a condenser.

The arrangement of the components such as condenser, turbine and generator, including the auxiliary devices in conjunction with the arrangement of the above-mentioned function areas, such as the preheating section, offers the following advantages in particular:

Because the concept includes a permanent assignment of function areas and component installations in the power house in particular, planning can take place with standardized modules and further advantages result in production due to defined interface areas. It is also possible to break down assembly and the assembly sequence. This has benefits even if the steam power plant is revised and relates both to the above-mentioned function areas and the turboset itself. Parallel assembly of components such as the condenser, turbine and generator and the units in the other function areas is also possible. Assembly time can thus be reduced.

Also with the selected arrangement the installation height of the turboset overall is reduced and therefore respectively the height of the power house.

With the steam power plant arrangement 10 the heater bay configuration (preheating system and e-area function areas) and the steam interface with the steam generator are independent of turboset and condenser development.

The discharge of tapped steam for further applications is possible in a flexible manner with many configurations. The installation concept and thus the assignment of components is not influenced.

Arranging the turbine in relation to the steam generator and the arrangement of the preheating section allows the conduits to be significantly shorter than in known arrangements. The arrangement of the preheating section or preheating system specifically allows a compact installation to be achieved while at the same time optimizing power house height. The cooling water and condensation unit can be configured without any impact on the selected installation concept and therefore the assignment concept of the function areas.

Finally, as mentioned above, the use of taps for further applications has no impact on the selected function area assignment. This is true both for a condensation turbine design and an extraction-condensation machine design. Even with a back-pressure machine configuration, there is no impact on most of the other function areas.

The invention claimed is:

1. A steam power plant layout arrangement for spatially defining a plurality of individual function areas of the plant, comprising:

a steam turbine;

a steam generator;

a condenser connected in a condenser function area to receive steam from an axial discharge of the steam turbine, the condenser function area includes a rectangular area to accommodate at least one conduit for supplying cooling water to the condenser; and a preheating system having a longitudinal axis, wherein the steam generator, the condenser and the preheating system are configured as individual functionally and spatially defined function areas that are arranged in a spatial installation concept in a distributed manner around the steam turbine, wherein the steam turbine has a longitudinal axis, and the condenser is coaxially positioned along the longitudinal axis of the steam turbine to be adjacent to the steam turbine, and the rectangular area for accommodating said at least one conduit for supplying cooling water to the condenser is positioned perpendicular relative to the longitudinal axis of the steam turbine, and further an electrotechnical function area is provided, which is arranged radially next to a generator of said turbine and parallel to the preheating system function area, wherein the preheating system is positioned relative to the turbine so that the longitudinal axis of the preheating system is perpendicular relative to the longitudinal axis of the turbine.

2. The steam power plant arrangement according to claim 1, wherein the steam turbine and the condenser function area are arranged on the same level.

3. A steam power plant layout arrangement for spatially defining a plurality of individual function areas of the plant, comprising:

a steam turbine;

a steam generator;

a condenser connected in a condenser function area to receive steam from an axial discharge of the steam turbine, the condenser function area includes a rectangular area to accommodate at least one conduit for supplying cooling water to the condenser; and a preheating system having a longitudinal axis, wherein the steam generator, the condenser and the preheating system are configured as individual functionally and spatially defined function areas that are arranged in a spatial installation concept in a distributed manner around the steam turbine, wherein the steam turbine has a longitudinal axis, and the condenser is coaxially positioned along the longitudinal axis of the steam turbine to be adjacent to the steam turbine, and the rectangular area for accommodating said at least one conduit for supplying cooling water to the condenser is positioned perpendicular relative to the longitudinal axis of the steam turbine, and further wherein the steam generator function area, the steam turbine, and a parallel arrangement of the preheating system function area, and an electrotechnical function area are arranged in series one behind the other, wherein the preheating system is positioned relative to the turbine so that the longitudinal axis of the preheating system is perpendicular relative to the longitudinal axis of the turbine.

4. The steam power plant arrangement according to claim 3, wherein the condenser function area is arranged parallel to the said series arrangement.

5. The steam power plant arrangement according to claim 1, wherein the connection of at least two function areas is made by a connection element selected from the group consisting of: pipes, steam conduits, electric cables, and combinations thereof.

* * * * *